US007246399B2

(12) United States Patent
Petner

(10) Patent No.: US 7,246,399 B2
(45) Date of Patent: Jul. 24, 2007

(54) MOP HEAD RETAINING CLAMP

(75) Inventor: Robert E. Petner, Burlington, NJ (US)

(73) Assignee: Quickie Manufacturing Corp., Cinnaminson, NJ (US)

( * ) Notice: Subject to any disclaimer, the term of this patent is extended or adjusted under 35 U.S.C. 154(b) by 341 days.

(21) Appl. No.: 11/101,070

(22) Filed: Apr. 7, 2005

(65) Prior Publication Data

US 2006/0225234 A1 Oct. 12, 2006

(51) Int. Cl.
*A47L 13/24* (2006.01)

(52) U.S. Cl. ..... 15/150; 15/147.1

(58) Field of Classification Search ..... 15/147.1, 15/150

See application file for complete search history.

(56) References Cited

U.S. PATENT DOCUMENTS

| | | | | |
|---|---|---|---|---|
| 116,512 | A | | 6/1871 | Todd |
| 283,121 | A | | 8/1883 | Lee |
| 1,376,175 | A | | 4/1921 | Sundermann, Jr. |
| 1,585,033 | A | * | 5/1926 | Hilton ..... 15/150 |
| 2,501,514 | A | * | 3/1950 | Hill ..... 15/150 |
| 3,457,581 | A | | 7/1969 | Oas |
| 4,287,632 | A | | 9/1981 | Hammond |
| 4,553,282 | A | | 11/1985 | Batchelor |
| 5,724,696 | A | | 3/1998 | Di Giammarino |
| 5,918,340 | A | | 7/1999 | Young |
| 6,098,235 | A | | 8/2000 | Tomm et al. |
| 6,637,065 | B2 | | 10/2003 | Biggs |

* cited by examiner

*Primary Examiner*—Randall Chin
(74) *Attorney, Agent, or Firm*—Stuart M. Goldstein

(57) ABSTRACT

A mop head retaining clamp has a mop handle receiving base member. A lower clamp arm, with retaining teeth is pivotally connected to the base at one end of the arm. The other end of the arm is pivotally connected to one end of a side arm member. The other end of the side arm member is pivotally connected to a handle attached to a lockable insert. The insert is sized to fit snugly into a cavity in the base member and is removeably locked in place by the interaction of the insert's extended front surface with a lipped section extending from the cavity. A mop head attached with this clamp is securely fastened to its mop handle during use, but it can be readily disengaged when the mop head needs to be replaced.

10 Claims, 3 Drawing Sheets

MOP HEAD RETAINING CLAMP

BACKGROUND OF THE INVENTION

Swab mops having mop heads made of yarn, cotton, or similar cloth-type strands are commonly used to clean soiled surfaces and to absorb moisture from wet surfaces. Of course during use, these mop heads become soiled and, after prolonged use, become worn and are no longer effective in cleaning operations, and the mop heads and mops on which they are mounted must be discarded. As a result, mops with removable mop heads are popular, in that when a mop head becomes unusable, it can be removed and replaced with a new mop head, thus preventing the entire mop from being discarded. To accomplish this, mop head holders or retaining clamps are used for removeably retaining mop heads on mop handles. However, no retaining device has been developed which truly securely maintains a mop head on its mop and which easily and readily allows the user to replace an old mop head with a new one, without difficulty and without the mess associated with removing an old, soiled and often wet mop head.

SUMMARY OF THE INVENTION

It is thus the object of the present invention to provide a mop head retaining clamp which assists in overcoming the disadvantages and limitations of the manner in which replaceable mop heads are currently changed.

It is an object of the present invention to provide a mop head retaining clamp which securely maintains a mop head on the mop handle during continued use.

It is a further object of the present invention to provide a mop head retaining clamp which can be readily and easily disengaged to allow an old mop head to be replaced with a new mop head.

It is still another object of the present invention to provide a mop head retaining clamp which uses a readily accessible handle to removeably secure and, when needed, disengage the mop head.

It is still another object of the present invention to provide a mop head retaining clamp which used a readily accessible handle to removeably secure and, when needed, disengage the mop head.

It is another object of the present invention to provide a mop head retaining clamp which allows replacement of an old mop head with a new mop head without subjecting the user to the dirt, moisture, and debris associated with the old mop head.

These and other objects are accomplished by the present invention, a mop head retaining clamp with a mop handle receiving base member. A lower clamp arm, with retaining teeth, is pivotally connected to the base at one end of the arm. The other end of the arm is pivotally connected to one end of a side arm member. The other end of the side arm member is pivotally connected to a handle attached to a lockable insert. The insert is sized to fit snugly into a cavity in the base member and is removeably locked in place by the interaction of the insert's extended front surface with a lipped section extending from the cavity. A mop head attached with this clamp is securely fastened to its mop handle during use, but it can be readily disengaged when the mop head needs to be replaced.

The novel features which are considered as characteristic to the invention are set forth in particular in the appended claims, the invention itself, however, both as to its design, construction, and use, together with additional features and advantages thereof, are best understood upon review of the following detailed description with reference to the accompanying drawings.

DETAILED DESCRIPTION OF THE INVENTION

Figure 1:
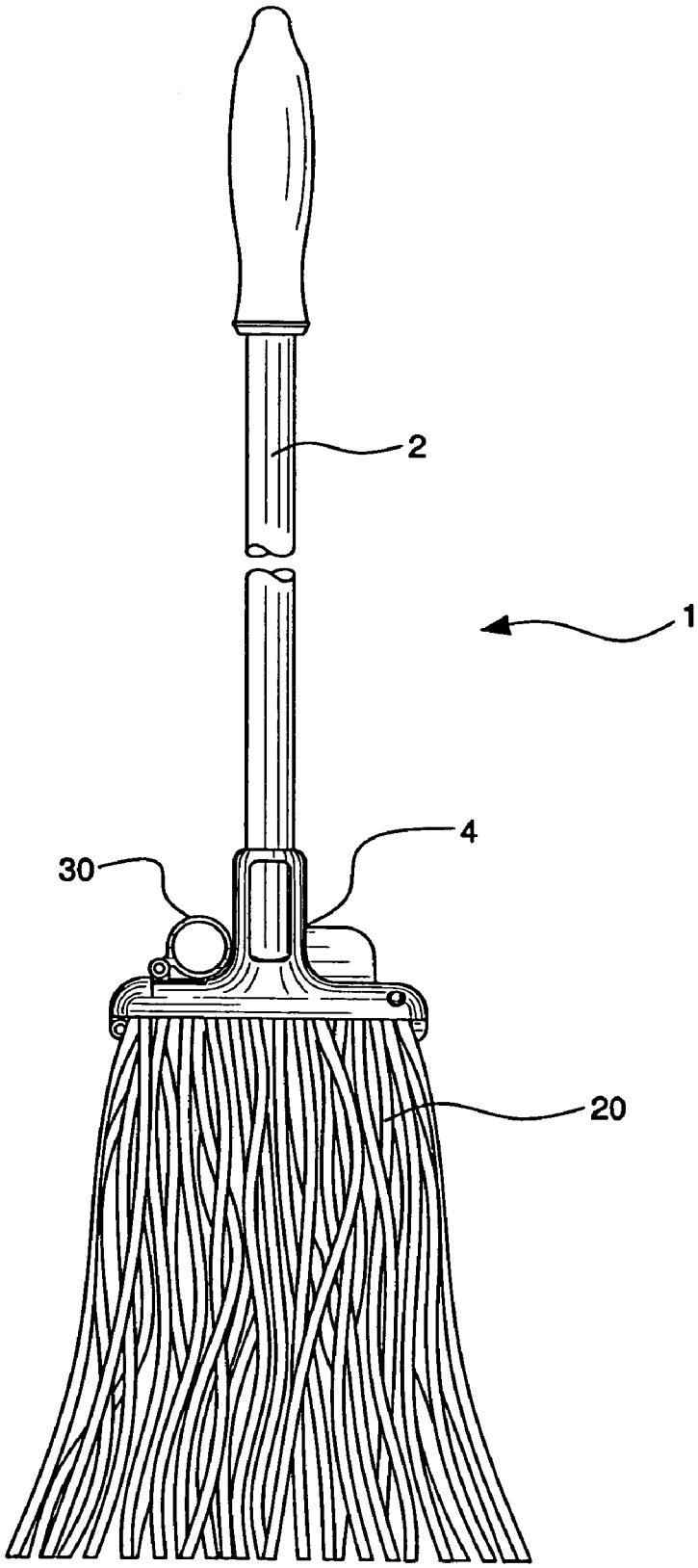
FIG. 1 is a front view of a mop with the mop head retaining clamp of the present invention.
Figure 2:
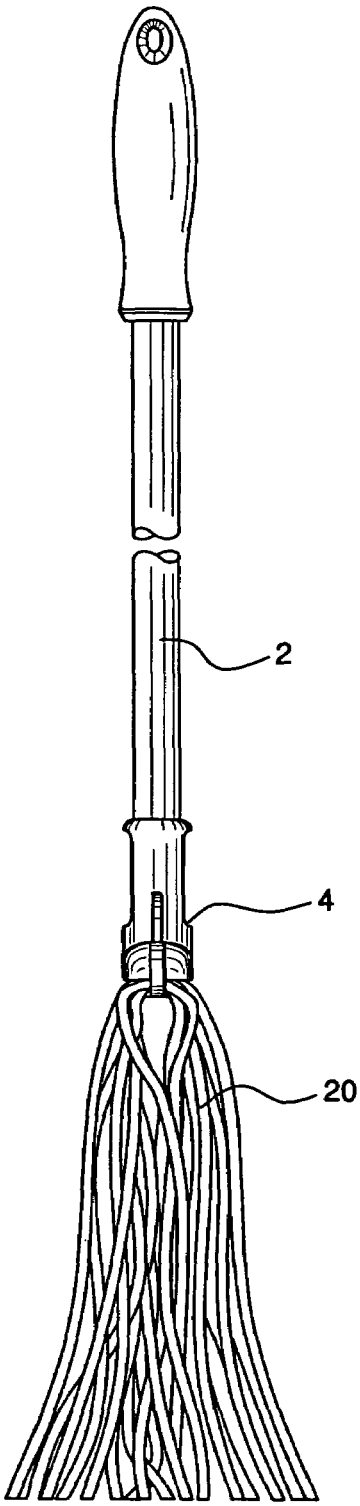
FIG. 2 is a side view of a mop with the mop head retaining clamp of the present invention.
Figure 3:
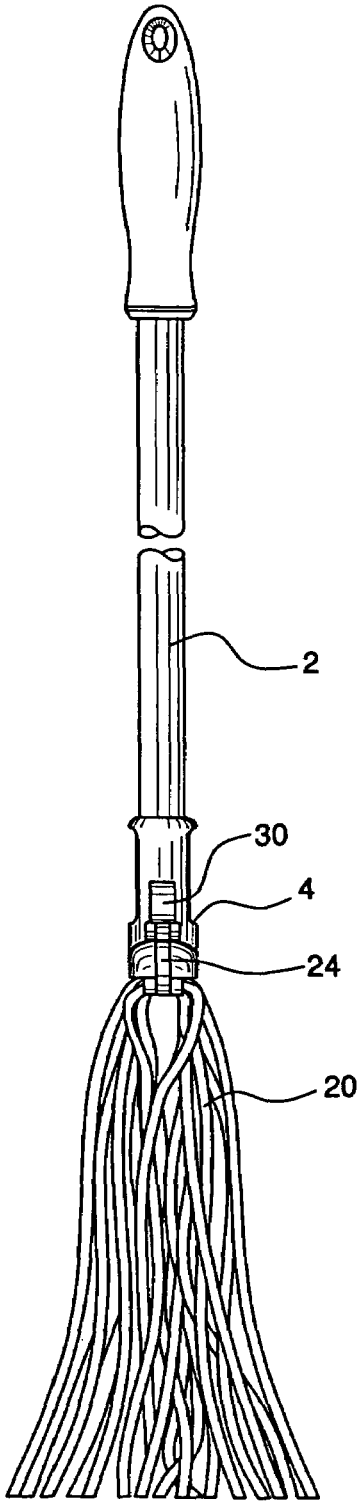
FIG. 3 is the other side rear view of a mop with the mop head retaining clamp of the present invention.
Figure 4:
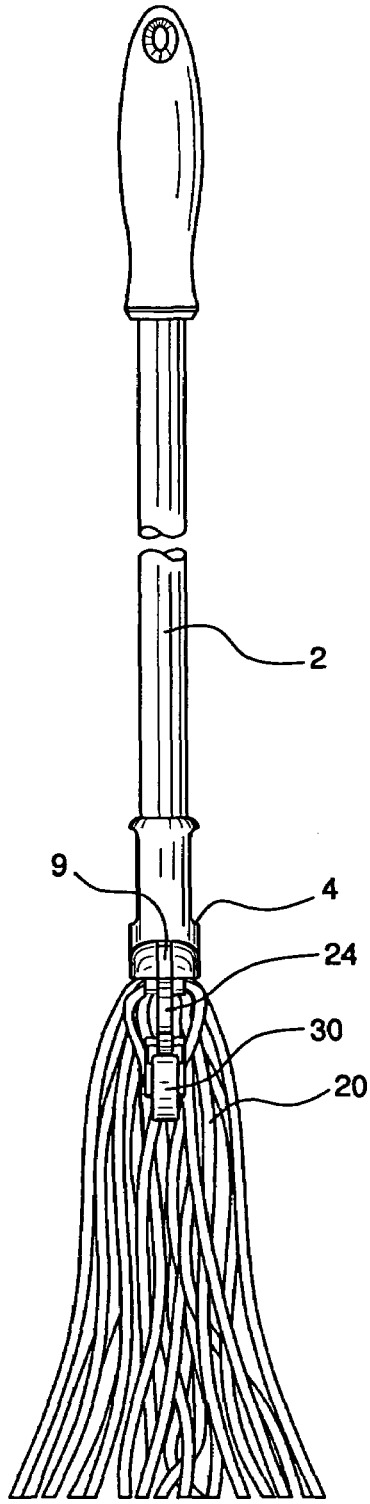
FIG. 4 is the side view shown in FIG. 3 with the mop head retaining clamp of the present invention in a disengaged position.

Mop 1 comprises handle 2 secured within mop head retaining clamp 4 of the present invention. Clamp 4 comprises base member 6 which is a unitary body having upstanding section 8 into which the lower end of handle 2 is mounted and secured. Slot 9 is inset within the side of lower section 10 of base member 6 which, at 12, pivotally mounts bottom arm 14. Arm 14 has teeth 16 configured to bite into and retain mop head 20 made of yarn or other cloth-type strands. As best seen in FIGS. 2, 3 and 4, mop head 20 is configured to be placed between base member 6 and arm 14 in the removeably secured, mop-use position.

Arm 14 is also pivotally connected at 22 to side arm 24, which itself is pivotally connected, at 26, to handle 30. Side arm 24 is sized to be positioned within slot 9. Locking insert 32 is rigidly fixed to handle 30. Insert 32 has a substantially flat bottom surface and extended front surface 34.

Lower section 10 of base member 6 comprises cavity 40, inset within the body of the base member. Cavity 40 comprises transversely extending lip section 42. Cavity 40 is sized to receive insert 32 such that the insert is fit snugly into the cavity in the removeably secured, mop-use position.

Figure 5:
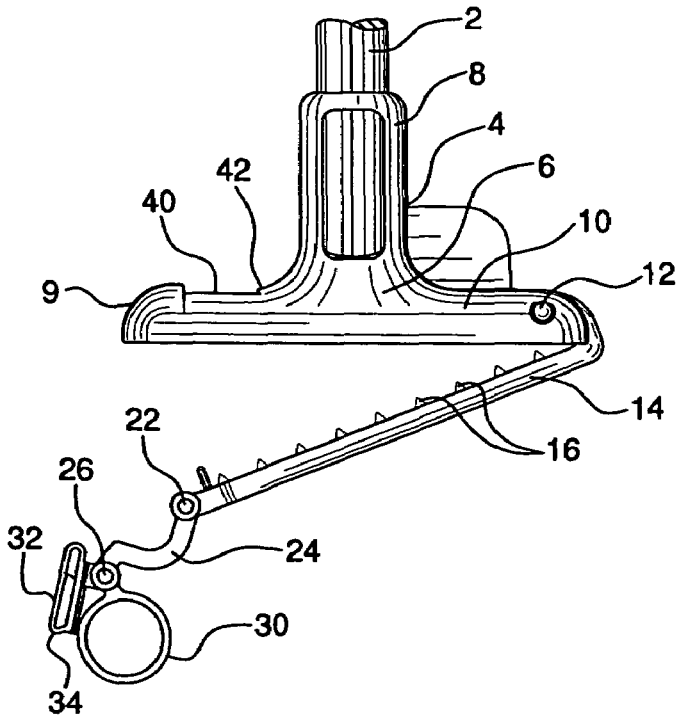
FIG. 5 is a front view of the mop head retaining clamp of the present invention in the disengaged position.
Figure 6:
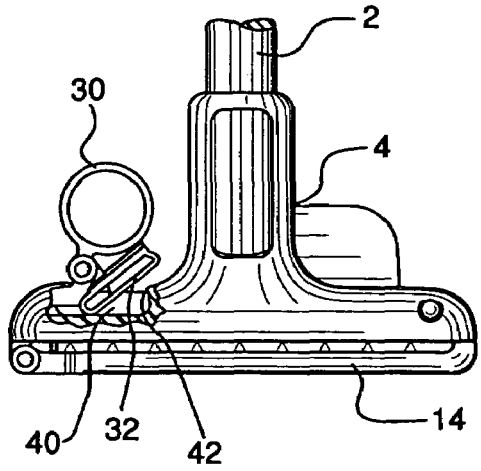
FIG. 6 is a front view of the mop head retaining clamp of the present invention as it is being disengaged.
Figure 7:
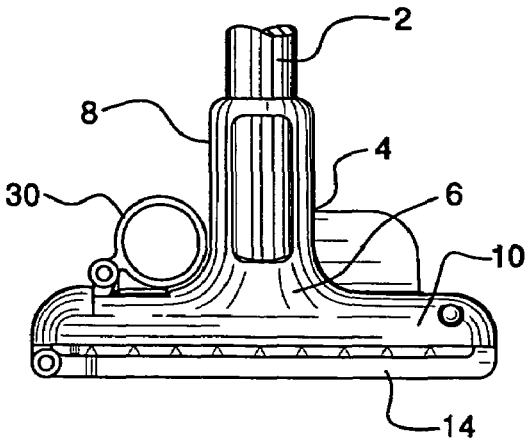
FIG. 7 is a front view of the mop head retaining clamp of the present invention in the removeably locked position.

In operation, arm 14 is pivoted down from base member 6, as show in FIG. 5, to accept the center section of a mop head, like mop head 20, shown in FIGS. 2, 3, and 4. Arm 14 is then pivoted upward towards base member 6 such that teeth 16 bite into the mop head, thus resulting in arm 14 being aligned substantially parallel with base member 6, as shown in FIG. 6. In this position, side arm 24 is pivoted upward and into slot 9 of base member 6. Handle 30 is then pivoted downward to permit insert 32 to enter cavity 40. Extended surface 34 of insert 32 is pushed over and then snaps under lipped section 42. This permits insert 32 to be removeably secured within the cavity, such that it is substantially encompassed by and fits snugly within the cavity. In this position, with side arm 24 positioned substantially within slot 9 and insert 32 within cavity 40, mop head 20 is tightly secured to mop 1.

To release and disengage mop head 20 from mop 1, handle 30 is pulled upward to overcome the engagement between front surface 34 of insert 32 and lip section 42 of cavity 40. Continued raising of handle 30 lifts insert 32 out of cavity 40 and arm 24 out of slot 9. This allows arm 14 to pivot downward in relation to base member 6. The old, used mop head is then lifted from arm 14 and removed from clamp 4. A new mop head 20 is positioned over arm 14 and clamp 4 re-engaged as described above.

Mop retaining clamp 4 thus provides an effective means of securing a mop head during use and allows for ready, easy, and clean replacement of an old and worn mop head with little effort and maximum efficiency.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A mop head retention clamp for securing a mop head to a mop handle, said clamp comprising:

(a) a base member connected to the handle, said base member being a unitary body having a side slot and an inset cavity extending into the body of the base member;

(b) lower attachment means pivotally connected directly to the base member for removeably securing the mop head to the base member;

(c) side attachment means pivotally connected to the lower attachment means for removeably securing the lower attachment means to the base member;

(d) handle means pivotally connected to the side attachment means for engaging and releasing the clamp, said handle means having insert means sized to fit, substantially in its entirety, within the cavity and hence within the body, whereby when the mop head is secured by the clamp, the insert means is substantially encompassed by and fits snugly within the cavity within the body, and the side attachment means is positioned substantially within the side slot to tightly secure the lower attachment means to the mop head.

2. The clamp as in claim 1 wherein the lower attachment means comprises teeth.

3. The clamp as in claim 1 wherein the insert means comprises an extended front surface section.

4. The clamp as in claim 3 wherein the cavity comprises lipped means for receiving the front surface section of the insert means, to removeably secure the insert means within the cavity.

5. The clamp as in claim 1 wherein the insert means is attached to and pivotable with the handle means.

6. A mop head retention clamp for securing a mop head to a mop handle, said clamp comprising:

(a) a base member connected to the handle, said base member being a unitary body having a side slot and an inset cavity extending into the body of the base member;

(b) a lower arm pivotally connected directly to the base member;

(c) a side arm pivotally connected to the lower arm;

(d) a clamp handle pivotally connected to the side arm, said handle having a locking insert sized to fit, substantially in its entirety, within the cavity and hence within the body, whereby when the mop head is secured by the clamp, the insert is substantially encompassed by and fits snugly within the cavity within the body, and the side arm is positioned within the side slot to tightly secure the lower arm to the mop head.

7. The clamp as in claim 6 wherein the lower arm comprises teeth.

8. The clamp as in claim 6 wherein the insert comprises an extended front surface section.

9. The clamp as in claim 8 wherein the cavity comprises lipped means for receiving the front surface section of the insert, to removeably secure the insert within the cavity.

10. The clamp as in claim 6 wherein the insert is attached to and pivotable with the handle.

* * * * *